United States Patent [19]

Devening

[11] Patent Number: 4,941,578

[45] Date of Patent: Jul. 17, 1990

[54] HIGH DENSITY STORAGE SYSTEM

[76] Inventor: Charles K. Devening, 11431 Village Brooke Ct., Cincinnati, Ohio 45249

[21] Appl. No.: 229,301

[22] Filed: Aug. 5, 1988

[51] Int. Cl.[5] ..... A47F 43/00

[52] U.S. Cl. ..... 211/186; 211/187

[58] Field of Search ..... 211/186, 187, 188, 189, 211/190, 191; 108/64

[56] References Cited

U.S. PATENT DOCUMENTS

| | | | |
|---|---|---|---|
| 447,658 | 3/1891 | Brockmann . | |
| 766,660 | 8/1904 | Bohannan . | |
| 2,076,848 | 4/1937 | Keiver . | |
| 2,812,041 | 11/1957 | Mugler . | |
| 2,915,195 | 12/1959 | Crosby . | |
| 3,570,683 | 3/1971 | Dickgiesser . | |
| 3,770,147 | 11/1973 | Kito et al. | 211/187 X |
| 3,801,176 | 4/1974 | Higbee . | |
| 3,921,814 | 11/1975 | Solomon . | |
| 3,967,868 | 7/1976 | Baker, Jr. . | |
| 4,017,131 | 4/1977 | Camenisch . | |
| 4,061,379 | 12/1977 | Randall . | |
| 4,240,353 | 12/1980 | Barth . | |
| 4,615,449 | 10/1986 | Naito et al. . | |

FOREIGN PATENT DOCUMENTS

| | | | |
|---|---|---|---|
| 1441450 | 5/1966 | France | 211/187 |
| 300021 | 11/1928 | United Kingdom | 211/187 |

OTHER PUBLICATIONS

"Top-Track Storage System"--excerpt from brochure of Inter-Metro Corporation.

*Primary Examiner*—Alvin C. Chin-Shue
*Assistant Examiner*—Sarah A. Lechok
*Attorney, Agent, or Firm*—Wood, Herron & Evans

[57] ABSTRACT

A high density, mobile storage system in which groups of racks are arranged side by side in a row, the racks being selectively movable individually or in groups so as to leave a loading and unloading space between any two of the racks. Each row of racks includes a pair of overhead rails supported by guide means on the upper corners of the racks, and all racks of each row are supported by floor supported wheels or casters. The wheels of the endmost racks of each row are selectively lockable against rotation, and the endmost racks of each row are selectively lockable to the overhead guide rails.

8 Claims, 3 Drawing Sheets

HIGH DENSITY STORAGE SYSTEM

This invention relates to storage rack systems, and more particularly, to a high density system of movable storage racks.

One common system of storage racks which achieves a high density storage capacity employs groups of racks arranged side by side in a row alongside a loading and unloading aisle, the individual racks being selectively movable either individually or in groups so as to leave a loading and unloading space between any two of the racks in the row. In order to maintain the row alignment of this type of high density, mobile rack storage system, the racks generally are mounted on wheels and are movable over a pair of spaced, parallel rails. Such a system is disclosed in U.S. Pat. No. 3,967,868. Or, as an alternative to the use of rails for maintaining the row alignment of such high density, mobile storage systems, the racks may be guided by a pair of spaced, parallel, overhead rails which are attached to the ceiling or walls of the room in which the racks are located. Such an overhead rail guide system is described in U.S. Pat. No. 3,570,683.

One problem characteristic of both floor rail guided, high density, mobile storage systems and ceiling rail guided, overhead, high density storage systems is the lack of flexibility of such systems. That is, they are permanently located in the room once the rails are located therein.

Another problem characteristic of floor rail guided, high density storage systems is that the systems collect dirt which is hard to clean, particularly in areas or rooms where the room must be maintained immaculately cleaned, as in hospital locations.

Yet another problem characteristic of both floor rail guided and overhead guided, high density, mobile storage systems is the cost of such systems, and particularly of installation of such systems.

It has been an objective of this invention to provide a high density, mobile storage system which eliminates the need for fixed ground supported rails or ceiling or wall supported guide rails for such a system and is therefore substantially more flexible and easier to maintain clean than prior systems.

Yet another objective of this invention has been to provide a high density, mobile storage system which is less costly and substantially more flexible than prior high density, mobile storage systems which required either a fixed floor mounted guide rail system or a ceiling or wall mounted guide rail system for maintaining the row alignment of multiple racks of the system.

These objectives are achieved in accordance with the practice of the invention of this application by a high density, mobile storage system in which groups of racks are arranged side by side in a row with the racks being selectively movable individually or in groups so as to leave a loading and unloading space between any two of the racks. The racks are mounted upon wheels which are rotatable, but secured against swivel rotation relative to the racks. To maintain the row alignment of the racks, the upper ends of the racks have guide means mounted thereon and movable over a pair of spaced, parallel guide rails. These guide rails are fixedly secured to the endmost racks in the row of racks, and the endmost racks are in turn secured against movement on the floor or supporting surface by locking of the wheels of those endmost racks against rotation. In accordance with the practice of this invention, the locks which secure the guide rails to the endmost racks in the row are selectively releasable such that the endmost racks may be released for movement relative to the guide rails for purposes of cleaning beneath those endmost racks. Alternatively, the locks which connect the guide rails to the endmost racks may be maintained locked to those endmost racks while the locks of the wheels of those endmost racks are released so as to facilitate movement of the complete row of racks.

The high density, mobile storage system of this invention has numerous advantages over prior high density, mobile storage rack systems which required either fixed floor mounted rails or fixed ceiling or wall mounted rails. In addition to being less costly and substantially more flexible than such fixed rail systems, this system may be conveniently installed in clean room applications wherein the floors must be maintained absolutely dirt and dust free. Furthermore, this system may be installed much less expensively than prior systems and with a minimum of tools, i.e., one allenhead wrench. Furthermore, this system does not hinder or in any way interfere with overhead fire sprinkling systems as do conventional ceiling mounted overhead rail systems Furthermore, this system lends itself to the addition of racks to a row or to the extension of the length of existing rows.

These and other objects and advantages of this invention will become more readily apparent from the following description of the drawings in which.

Figure 1:
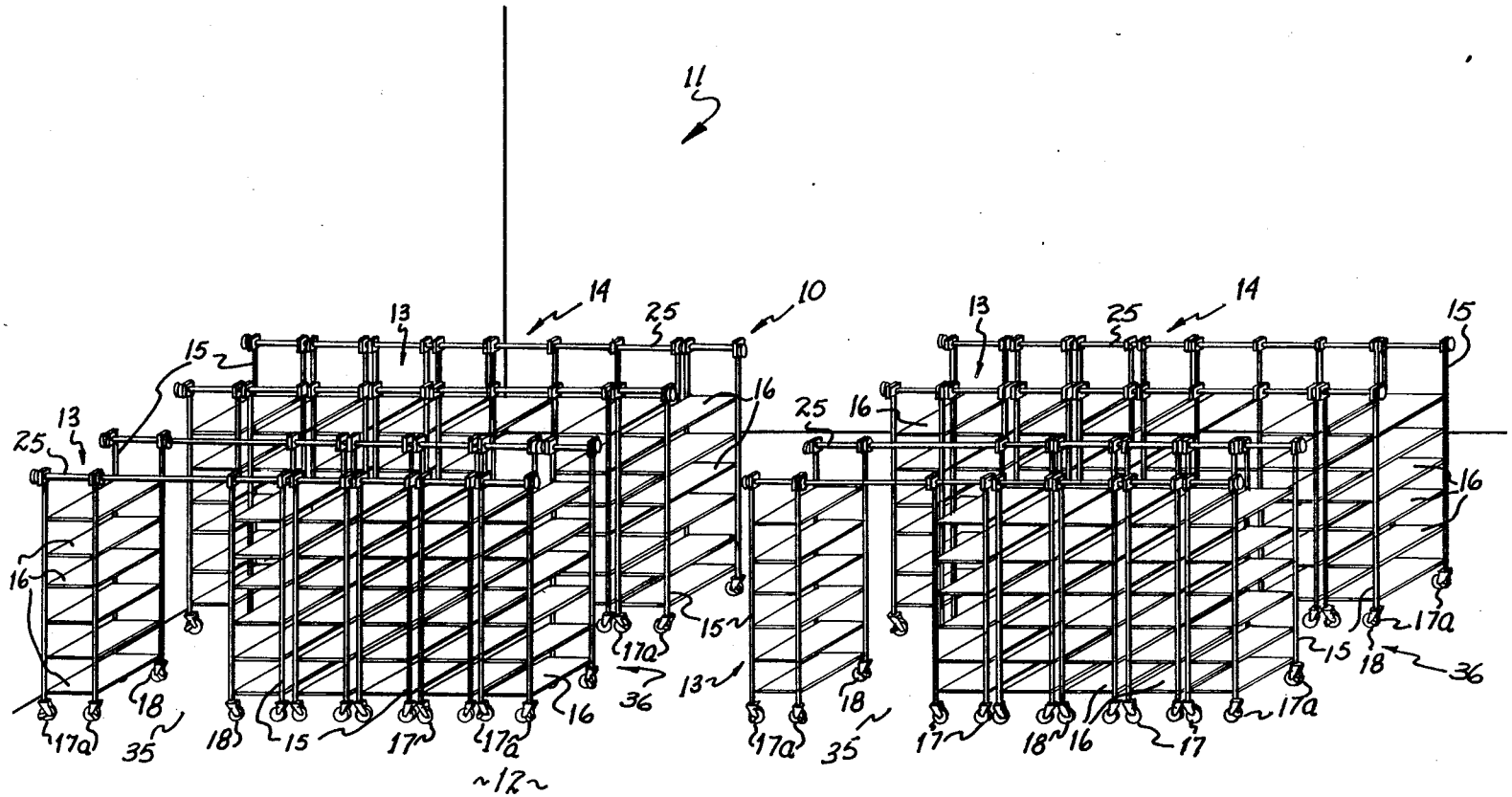
FIG. 1 is a perspective view of a high density, mobile storage system incorporating the invention of this application.

With reference first to FIG. 1 there is illustrated a high density, mobile storage system 10 contained within a room 11 having a floor 12. This system comprises groups of shelving racks 13 arranged in rows 14.

The shelving racks 13 each comprise four corner posts which support multiple shelves 16. Casters 17 are mounted in the lower end of each of the four corner posts 15 of each rack. These casters support rotatable wheels 18 which rotate about a horizontal axis. The wheels of the casters, though, do not swivel or pivot about a vertical axis, but are fixed to the posts such that the wheels all rotate about parallel, horizontal axes, which axes extend perpendicular to the length of the rows of shelving racks.

The shelving racks 13 described hereinabove are conventional racks which per se do not form any portion of the invention of this application. They may be purchased from numerous sources with many different styles of shelves supported from the four corner posts 15 of the racks.

Figure 2:
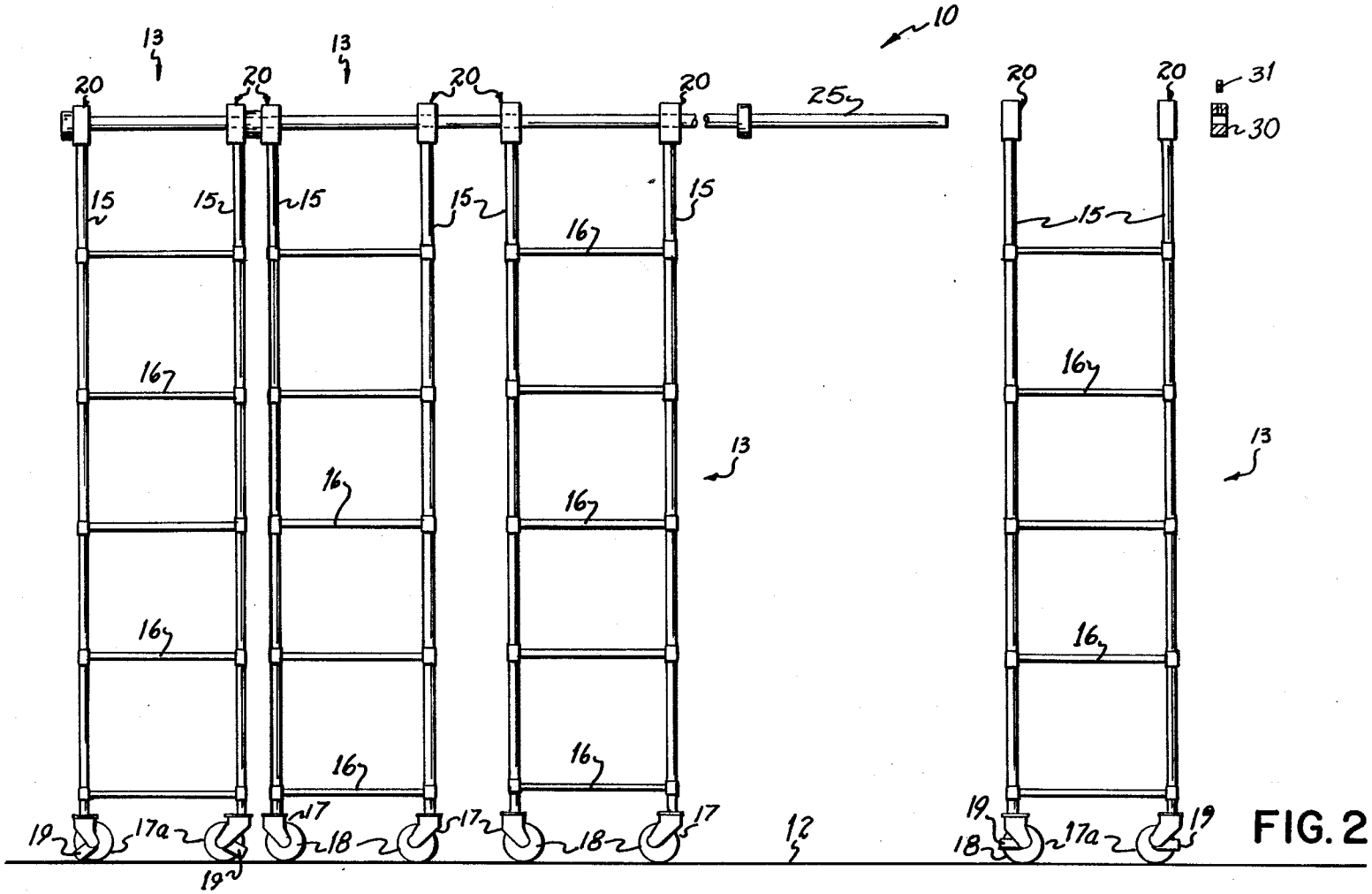
FIG. 2 is a side elevational view of one row of racks employed in the system of FIG. 1.
Figure 3:
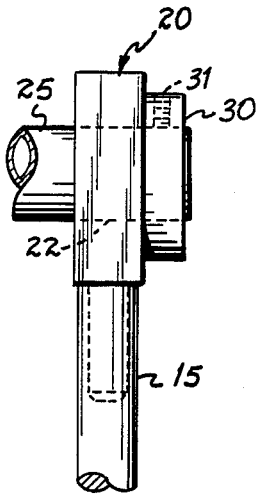
FIG. 3 is an enlarged side elevational view of the connection of one end rack of the system of FIG. 1 to a guide rail.
Figure 4:
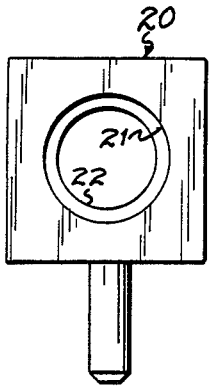
FIG. 4 is a front elevational view of a guide block used for connecting the top of a rack to a guide rail to facilitate sliding movement of the rack relative to rail.
Figure 5:
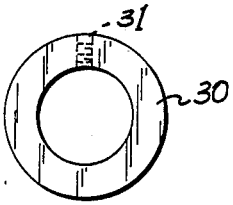
FIG. 5 is a front elevational view of a collar for securing a guide rail to the top of an endmost rack in a row of racks.

In accordance with the invention of this application, each rack has a guide block 20 (FIGS. 2, 3 and 4) mounted in the top of each corner post 15. The corner posts are preferably tubular such that a support post 23 depending from the underside of the guide block 20 may be received into the hollow upper end of the corner posts 15. Each block is generally rectangular in configuration and has a central bore 21 extending therethrough. An annular bearing 22 is preferably mounted in the bore 21 of each block 20.

In order to maintain the row alignment of the shelves and to facilitate linear movement of the shelves, the guide blocks 20 in the tops of the corner posts support guide rails 25. For each row of racks, there are a pair of these spaced, parallel guide rails 25. A pair of guide blocks 20 at each end of each rack extend over each guide rail 25 of that row. The inner diameter of the bearings 22 in the blocks is slightly larger than the outside diameter of the guide rails 25 such that the guide blocks 20 may slide freely over the guide rails 25.

In accordance with the practice of this invention, the endmost ones of the shelving racks 13 in each row of racks 14 are fixedly secured to the guide rails 25 associated with that row. To that end, a pair of annular collars 30 are mounted over the guide rail on the outside of the guide blocks of the endmost racks. These collars 30 are fixed to the guide rails by set screws 31.

The casters 17*a* of the endmost shelving racks 13 in each row of racks differ from the casters of all of the other shelving racks in the same row in that those casters of the endmost racks have locking brakes 19 mounted thereon. These brakes are in the form of a yoke pivotally mounted upon the axle of the casters and movable between an upper position in which the brakes are out of engagement with the floor upon which the caster rests and a lower position in which the brakes engage the floor and prevent movement of the caster. Brake equipped casters are conventional and per se form no part of the invention of this application. One caster having a brake mounted thereon suitable for use in the practice of this invention is illustrated in U.S. Pat. No. 2,812,041.

In order to assemble a row of shelving racks in accordance with the practice of this invention, the guide blocks 20 of a first endmost rack are assembled to a pair of guide rails 25. This involves slipping the two endmost guide blocks 20 at one end of a rack 13 over one guide rail and slipping the two guide blocks 20 on the opposite end of the rack 13 over a second guide rail 25. Locking collars 30 are then placed over the guide rails 25 on opposite sides of the rack with the locking collars resting against the outer edge of each of the four guide blocks mounted in the upper ends of the four corner posts of this first shelf. The locking screws 31 of those four locking collars are then fixed to the shafts. The caster brakes 19 associated with the casters on the lower end of this first or endmost shelving rack are then locked to the floor so as to prevent movement of the endmost rack relative to the floor.

All but the other end rack of the row of racks are then mounted over the guide rails 25 of the row of racks 14. This involves sliding two end guide blocks of each rack over one of the guide rails 25 until all of the guide blocks of all of the racks in the row are located over the rails, except for the second endmost rack. Before this second endmost rack is connected to the guide rails 25, a pair of collars 30 are fitted over the shafts 25. The guide blocks 20 of the endmost rack are then fitted over the guide rails 25, and end collars 30 are then positioned over the ends of the rails 25. The locking collars 30 associated with this second endmost rack are then fixed to the guide rails by the set screws 31.

It is important to note that in the assembly of the shelving racks to the guide rails, a loading and unloading space is left between two of the racks. Because of the presence of this unloading and loading space 35, all but the endmost racks may be selectively moved individually or in groups so as to reposition the loading and unloading space between any two of the racks. Thereby, the density of the racks which may be contained within a selected area is maximized.

In accordance with this invention, multiple rows of racks are arranged in parallel with access aisles 36 located between the rows of racks.

In the use of the high density storage system 10 of this invention, one or more rows of shelving racks are arranged as illustrated in FIG. 1. In this arrangement, the endmost racks of each row of racks are secured to the floor by locking of the casters 17*a* associated with that rack against rotation. These same endmost racks are secured to the guide rails 25 by the locking collars 30. The remaining racks 13 of each row are then individually movable or movable as a group so as to relocate the loading and unloading space 35 between any two of the racks.

In the event that it should become necessary to move the racks, all that is required is to release the brakes 17*a* of the endmost racks and reposition the complete row of racks. Such movement might be necessary, for example, in order to clean the area of the floor beneath the racks, and particularly the endmost racks. Or, alternatively, the locking collars 30 may be removed from the endmost racks so that those endmost racks may be moved either off of the guide rails or along the guide rails for purposes of cleaning beneath those endmost racks or for purposes of moving the end racks so as to gain access to the underside thereof.

The primary advantage of the high density, mobile storage system described hereinabove over prior high density, mobile storage systems is that it utilizes guide rails which are not fixed to the floor or fixed to the ceiling or walls of the room or building within which the system is utilized. Consequently, the system is very flexible in that it enables the rows of shelves to be located anywhere in a room and located therein by simply locking the wheels of the casters to the floor by means of the brakes associated with the casters. This flexibility is very desirable for many applications. Furthermore, the mobility of all of the racks of the system enables the floor of a room within which the racks are contained to be easily cleaned. The system also lends itself to the addition of additional length to existing rows of racks, and the construction of the system is such that it may very easily and quickly be installed in a room or removed from a room and reinstalled in a new location.

While I have described only a single preferred embodiment of my invention, persons skilled in the art to which this invention pertains will appreciate changes and modifications which may be made without departing from the spirit of my invention. As an example, the caster brakes which secure the endmost racks to the floor and against movement could be replaced by other types and styles of brakes which are connected to the casters. Furthermore, other styles of guide blocks, rails and locks for securing the endmost shelving racks to the rails could be substituted for the guide blocks 20, collars 30 and guide rails 25 described hereinabove. Therefore, I do not intend to be limited except by the scope of the following appended claims:

What is claimed:

1. A system of shelving racks, said system comprising a pair of end racks and multiple inner racks supported between said end racks, each of said racks having four vertical corner posts and horizontal shelves supported from said posts, each of said racks including said end racks having wheels mounted on the lower ends of said posts, said wheels being adapted to be rotated about horizontal axes and movable over a horizontal support surface, guide means mounted on the tops of each of the corner posts of said racks, a pair of upper straight, parallel guide rails supported solely from said guide means, means for securing the guide means of said end racks to said guide rails, and means for releasably locking at least two wheels of each of said end racks against rotation so as to selectively prevent movement of said end racks over said horizontal support surface.

2. The system of shelving racks of claim 1 wherein each of said wheels of each of said racks is fixed against swivel action relative to said racks.

3. The system of shelving racks of claim 1 wherein said means for securing the guide means of said end racks to said guide rails are releasably secured to said guide rails.

4. A high density, mobile storage system in which groups of racks are arranged side by side in a row alongside a loading and unloading aisle, the racks being selectively movable individually or in groups so as to leave a loading and unloading space between any two of the racks of each row, which system comprises a plurality of racks arranged side by side in a longitudinally extending row, each row of racks including a pair of end racks, each of said racks having an upper end and a lower end, each of said racks of each row including said end racks being supported at its lower end from four corner wheels, each of said wheels being rotatable about a horizontal axis, a pair of longitudinally extending, overhead guide rails, guide means interconnecting said upper ends of each of said racks to said guide rails, means for locking the guide means of endmost racks in said row of racks to said guide rails, and means for selectively locking at least a pair of wheels of the four corner wheels of each of said endmost racks in said row of racks against rotation.

5. The system of shelving racks of claim 4 wherein each of said wheels of each of said racks is fixed against swivel action relative to said racks.

6. The system of shelving racks of claim 4 wherein said means for securing the guide means of said end racks to said guide rails are releasably secured to said guide rails.

7. The system of claim 1 in which said pair of guide rails comprise a pair of parallel guide rods and wherein said guide means engage and ride over the outside peripheral surface of said guide rods.

8. The system of claim 4 in which said pair of guide rails comprises a pair of parallel guide rods and wherein said guide means engage and ride over the outside peripheral surface of said guide rods.

* * * * *